US009364696B2

(12) United States Patent
Kozlowski

(10) Patent No.: US 9,364,696 B2
(45) Date of Patent: Jun. 14, 2016

(54) REGULATORY COMPLIANT FIRE EXTINGUISHER

(71) Applicant: Knowlemics Corporation, Wheaton, IL (US)

(72) Inventor: Kevin Kozlowski, Wheaton, IL (US)

(73) Assignee: OVAL FIRE PRODUCTS CORPORATION, Wheaton, IL (US)

( * ) Notice: Subject to any disclaimer, the term of this patent is extended or adjusted under 35 U.S.C. 154(b) by 370 days.

(21) Appl. No.: 13/833,519

(22) Filed: Mar. 15, 2013

(65) Prior Publication Data

US 2014/0182867 A1 Jul. 3, 2014

Related U.S. Application Data

(60) Provisional application No. 61/748,124, filed on Jan. 1, 2013.

(51) Int. Cl.

| | |
|---|---|
| ***A62C 13/00*** | (2006.01) |
| ***B05B 9/08*** | (2006.01) |
| ***B05B 7/24*** | (2006.01) |
| ***A62C 13/76*** | (2006.01) |

(52) U.S. Cl.

CPC ..... *A62C 13/003* (2013.01); *A62C 13/76* (2013.01); *B05B 7/241* (2013.01); *B05B 9/0805* (2013.01)

(58) Field of Classification Search

CPC ..... A62C 11/00; A62C 11/005; A62C 13/00; A62C 13/003; A62C 13/62; A62C 13/76; B65D 7/02; B65D 7/04; B65D 7/42; B65D 7/44; B65D 9/02; B65D 9/04; B65D 2519/00577; B65D 2519/00616; B65D 2519/00532; B65D 19/02; B65D 19/10; B65D 19/08; B65D 90/02–90/08; F16J 12/00; F17C 2201/01; F17C 2201/0104; F17C 2201/0128; F17C 2203/013; B05B 7/241; B05B 9/0805

USPC ..... 169/71

See application file for complete search history.

(56) References Cited

U.S. PATENT DOCUMENTS

| | | | | |
|---|---|---|---|---|
| 2,378,426 | A * | 6/1945 | Myers | 239/373 |
| 2,594,223 | A * | 4/1952 | Santarelli | 222/385 |
| 8,020,722 | B2 * | 9/2011 | Richards et al. | 220/584 |
| 8,235,240 | B2 * | 8/2012 | Hausberger | 220/560.1 |
| 2005/0011891 | A1 * | 1/2005 | Austerhoff et al. | 220/4.12 |
| 2007/0246461 | A1 * | 10/2007 | Shimada et al. | 220/4.12 |
| 2008/0237240 | A1 * | 10/2008 | Hausberger | 220/560.07 |
| 2010/0230422 | A1 * | 9/2010 | Illesi | 220/586 |
| 2011/0024431 | A1 * | 2/2011 | Yano et al. | 220/581 |
| 2011/0031257 | A1 * | 2/2011 | Metz | 220/624 |

* cited by examiner

*Primary Examiner* — Arthur O Hall
*Assistant Examiner* — Juan C Barrera
(74) *Attorney, Agent, or Firm* — Richards Patent Law P.C.

(57) ABSTRACT

A pressurized vessel including a pressurized vessel cylinder and dispersal unit. The pressurized vessel cylinder includes a non-circular cylindrical body and at least one truss structure connecting the first side of the body to the second side of the body, wherein the truss structure includes one or more voids such that fluid communication is maintained throughout the interior of the cylinder.

20 Claims, 6 Drawing Sheets

REGULATORY COMPLIANT FIRE EXTINGUISHER

CROSS-REFERENCE TO RELATED APPLICATIONS

This application incorporates by reference and claims priority to U.S. Provisional Application No. 61/748,124 filed on Jan. 1, 2013.

BACKGROUND OF THE INVENTION

The present subject matter relates generally to a pressurized vessel. More specifically, the present invention is a pressurized vessel cylinder designed to more easily enable regulatory compliant installation of a fire extinguisher and its attendant components in varied commercial and residential applications.

Fire extinguishers play a vital role in preserving both life and property. It has been estimated that these devices were used to extinguish more than 80 percent, or five million, of the unintended fires in the United States in 2010. The most common portable fire extinguishers are those having a cylinder capacity to hold either five pounds or ten pounds of fire extinguishing agent. These types of fire extinguishers are ubiquitous in commercial structures.

Unsurprisingly, fire extinguishers are also subject to legal and regulatory scrutiny. Although there is no all-encompassing fire code in the United States, most state and municipal governments (largely by adoption of the International Fire Code) have enacted health and safety laws regarding fire extinguishers. Regulatory entities play a large role as well. For example, the American National Standards Institute (hereinafter "ANSI") publishes structural integrity standards for fire extinguisher cylinder manufacturing. Additionally, the Americans with Disabilities Act Design Guidelines (hereinafter "the ADADGs") provide fire extinguisher installation compliance guidelines intended to protect people with disabilities. Of course, numerous other regulatory bodies may provide regulation and/or testing requirements for fire extinguishers, including OSHA, NFPA, D.O.T., C.G.A., and UL. While much of the description provided herein centers around examples related to ANSI, it is contemplated that the requirements or tests any of these or other agencies may be equally or more important.

The ADADGs require that anything mounted above 27 inches, including fire extinguishers and extinguisher cabinets, cannot protrude more than four inches into a path of travel. Five-pound capacity fire extinguishers, as presently being manufactured and installed, are circular in cross section and protrude greater than four inches from the mounting surface or wall unless they are recessed into the mounting surface or wall within a cabinet or niche. In fact, no existing fire extinguishers have at least a five-pound capacity and also a cylinder depth (i.e., cross section diameter) of less than 4.25 inches. Many of these devices are currently installed in violation of the ADADGs.

Practical and aesthetic problems with fire extinguisher installation abound as well. The most common depth of framing studs for commercial drywall partitions (e.g., walls) is 3.625 inches, and the most common depth for residential construction framing studs is 3.5 inches. Meanwhile, the depth of the smallest five-pound fire extinguisher presently manufactured is 4.25 inches. It is therefore impossible to install a five-pound or larger fire extinguisher into a "flush" or "fully recessed" style fire extinguisher cabinet if the walls were framed with either 3.625 inch or 3.5 inch studs. The semi-recessed cabinets which are presently manufactured to house existing fire extinguishers within a 3.625 inch or 3.5 inch studded wall will protrude from the wall anywhere between 1.5 to 4 inches. Fire extinguisher cabinets which are fire-rated will protrude even more than non-rated cabinets, as the cabinet walls are thicker. Consequently, if there is a desire (aesthetics) or need (clearances) to further recess the present fire extinguisher cabinet types, (i.e., to a flush or fully recessed cabinet position) then either the wall depth must be increased or the fire extinguisher must be relocated where it is either not an obstruction or it is aesthetically acceptable. Each of these options may be impractical or cost-prohibitive for designers of commercial structures where fire extinguishers are required.

As such, there is a need for a pressurized vessel of alternate shape that dispenses material under adequate force while maintaining the integrity of the cylinder and complying with federal regulation regarding fire extinguishers.

BRIEF SUMMARY OF THE INVENTION

In order to meet the existing need to provide a pressurized vessel that may be more easily used in a manner compliant with regulatory requirements and housed within a wall constructed of common depth framing studs, the present subject matter discloses a pressurized vessel extinguisher may be a device having a cylinder depth sufficiently shallow to permit compliance with regulations providing spatial tolerances applicable to fire extinguisher installation. Further, the pressurized vessel cylinder may be substantially hollow, oval in cross-section, and manufactured to endure the myriad internal forces that are a concern of regulatory standards applied to fire extinguisher construction. In some embodiments, the pressurized vessel cylinder may be a portable device having a capacity for at least five pounds of dispensing material, such as, fire extinguishing agent.

The pressurized vessel may be installed at a mounting surface, such as a wall, in a location subject to the ADADGs. When installed in such a location, the pressurized vessel may protrude from the mounting surface no further than an allowable distance as provided by the ADADGs, for example, four inches. In one embodiment, the fire extinguisher may be attached directly to a mounting surface. In an alternative embodiment, the fire extinguisher may be harbored in a cabinet that is either attached directly to or recessed within the mounting surface. The fire extinguisher fits into cabinets that are fully recessed between common depth framing studs, thereby enabling a flush mount installation that may be aesthetically appealing.

The pressurized vessel cylinder may be manufactured in compliance with ANSI standards. In some embodiments, the oval cylinder structure of the fire extinguisher may be constructed from a lightweight, extruded material supported by internal tension trusses. The combination of the cylinder body, cylinder caps, and tension trusses may be provided to allow the cylinder to meet hydrostatic testing requirements without cylinder expansion or deformation. The overall design of the pressurized vessel cylinder is critical to meeting burst strength requirements as well.

In an embodiment, the pressurized vessel cylinder includes a non-circular cylindrical body including a first side, second side, and an interior. The pressurized vessel cylinder also includes at least one truss structure that is configured to maintain fluid communication throughout the interior. The truss structure may extend from an upper portion of the body to a lower portion of the body.

In an example, the truss structure is configured to maintain a distance between the first side and second side under pressurized conditions. The truss structure may comprise a first beam and second beam connected by at least one rung, wherein the first beam is attached to the first side of the body, wherein the second beam is attached to the second side of the body. The position of the rungs may create voids that maintain fluid communication throughout the interior. In an example, the first beam and second beam extend in parallel from the upper portion of the body to the lower portion of the body.

In another example, the truss structure comprises at least one crossbeam joining a first truss structure and a second truss structure.

In a preferred embodiment, the cross-section of the body of the pressurized vessel cylinder is oval shaped.

In an embodiment, the pressurized vessel cylinder comprises fire extinguishing agent under pressurized conditions.

The pressurized vessel may include the pressurized vessel cylinder disclosed herein and a dispersal unit in communication with the pressurized vessel cylinder enabled to dispense material stored inside the cylinder. In a preferred embodiment, the pressurized vessel is a fire extinguisher and the material comprises a fire extinguishing agent. Further, the distance between the first side and the second side may be four inches or less to comply with regulations surrounding fire extinguishers.

In a preferred embodiment, the pressurized vessel cylinder may have a depth of four inches or less while having a capacity for at least five pounds of dispensing material.

An advantage of the pressurized vessel is that it enables a user to install fire extinguishers in a manner compliant with various regulatory requirements.

Another advantage of the pressurized vessel is that it enables a user to avoid fines and remodeling expenses associated non-compliant installation of pressurized vessels in commercial structures.

Another advantage of the pressurized vessel is that its shallow depth cylinder design affords a practical and aesthetically pleasing flush installation of the pressurized vessel between common depth framing studs Yet another advantage of the pressurized vessel is that it employs an oval cross-section cylinder equipped with an internal truss structure and cylinder caps jointly designed to meet hydrostatic testing and burst strength requirements. For example, a preferred embodiment of the pressurized vessel maintain structural integrity at internal pressures up to at least 585 psi.

A further advantage of the pressurized vessel is that it is of a portable and lightweight design, enabling installation of the device in locations where heavier pressurized vessel installations are noncompliant.

Additional objects, advantages and novel features of the examples will be set forth in part in a description which follows, and in part will become apparent to those skilled in the art upon examination of the following description and the accompanying drawings or may be learned by production or operation of the examples. The objects and advantages of the concepts may be realized and attained by means of the methodologies, instrumentalities and combinations particularly pointed out in the description.

BRIEF DESCRIPTION OF THE DRAWINGS

The drawing figures depict one or more implementations in accord with the present concepts, by way of example only, not by way of limitations. In the figures, like reference numerals refer to the same or similar elements.

DETAILED DESCRIPTION OF THE INVENTION

Figure 1:
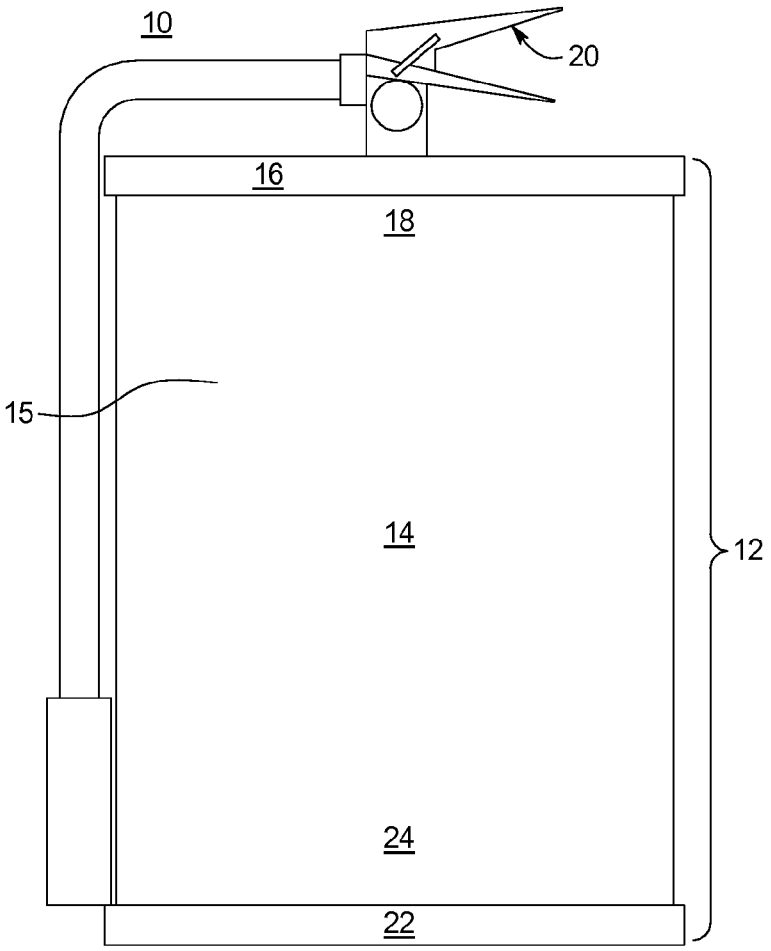
FIG. 1 is a front perspective illustration of a pressurized vessel according to the teachings provided herein.
Figure 2:
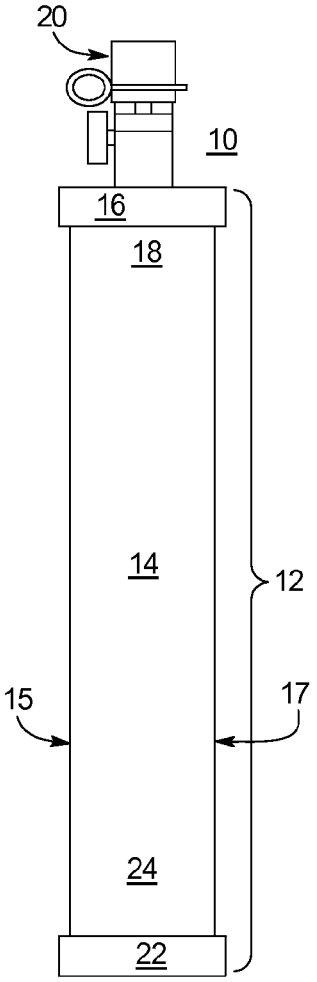
FIG. 2 is a side perspective illustration of the pressurized vessel shown in FIG. 1A.

FIGS. 1 and 2 illustrate an example of a pressurized vessel 10 embodying the teachings provided herein. As shown in both FIG. 1, a front perspective, and FIG. 2, a side perspective, the pressurized vessel 10 includes a pressurized vessel cylinder 12 and a dispersal unit 20. The pressurized vessel cylinder 12 includes a non-circular body 14 comprising a first side 15, a second side 17, an upper portion 18 and a lower portion 24, wherein the body 14 defines an interior 34. The pressurized vessel cylinder 12 may further comprise an upper cap 16 on the upper portion 18 of the body 14, and a lower cap 22 on the lower portion 24 of the body 14. The pressurized vessel further comprises a dispersal unit 20 that is attached to the upper cap 16, although it is contemplated that the dispersal unit 20 may be attached to another section or portion of the pressurized vessel 10. The dispersal unit 20 may be a well-known device adapted for attachment to the upper cap 16 and use with the pressurized vessel 10 as will be recognized by those skilled in the art.

The body 14, the upper cap 16, and the lower cap 22 may each be formed using any manufacturing process and any structural material appropriate for use in a pressurized vessel. For example, the body 14 may be formed from extruded aluminum and the caps 16, 22 may be formed from stamped aluminum. Of course, numerous known substitutes for each may be used, as will be recognized by those skilled in the art. For example, the pressurized vessel cylinder 12 may be machined rather than extruded. Additionally, since the pressurized vessel 10 is a portable device that may be used in the presence of high temperatures and pressures, the pressurized vessel cylinder 12 may be formed from lightweight materials that are both temperature and pressure resistant.

As further shown in FIGS. 1 and 2, the embodiment of the pressurized vessel 10 shown includes a pressurized vessel cylinder 12 having a specific height, width, and depth. For example, the pressurized vessel cylinder 12 may be 11.375 inches wide, 15 inches tall and 3.25 inches deep. In another example, the pressurized vessel cylinder 12 may be 11.375 inches wide, 21.5 inches tall and 3.25 inches deep. It is contemplated, however, that the pressurized vessel cylinder 12 dimensions may vary as will be recognized by those skilled in the art based on the disclosure provided herein. The pressurized vessel cylinder 12 may be various sizes. For example, the pressurized vessel cylinder 12 may be a five-pound pressurized vessel or a ten-pound pressurized vessel. It is contemplated, however, that the pressurized vessel cylinder 12 dimensions may vary as will be recognized by those skilled in the art based on the disclosure provided herein.

The cylinder body 14 defines an interior 34. The interior 34 may be filled with any material appropriate for dispersal from a pressurized vessel. For example, the interior 34 may be filled with a fire extinguishing agent, including a dry chemical such as monoammonium phosphate. Of course, numerous known substitutes may be used, as will be recognized by those skilled in the art. Additionally, actuation of the dispersal unit 20 may cause the release of the fire extinguishing agent from the pressurized vessel cylinder 12 in a well-known manner.

Figure 3A:
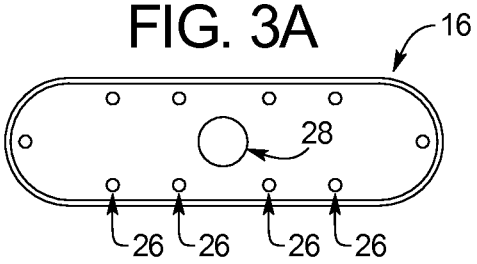
FIG. 3A is a cross-sectional illustration of an upper cap for a pressurized vessel.
Figure 3C:
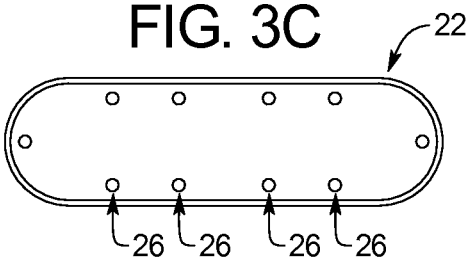
FIG. 3C is a cross-sectional illustration of a lower cap for a pressurized vessel.
Figure 3B:
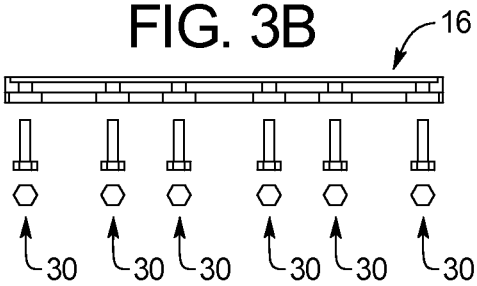
FIG. 3B is a cross-section illustration of the upper cap for the pressurized vessel shown in FIG. 3A.
Figure 3D:
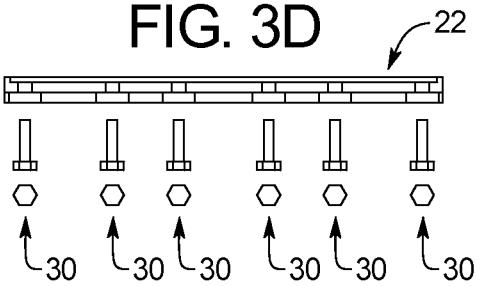
FIG. 3D is a longitudinal cross-section illustration of the lower cap for the pressurized vessel shown in FIG. 3C.

An example of the upper cap 16 is shown in FIGS. 3A and 3B. FIG. 3A shows a cross-sectional illustration of the upper cap 16 having a plurality of small holes 26 and a large hole 28 disposed therein. FIG. 3B shows a longitudinal-section illustration of the upper cap 16 and a plurality of fasteners 30. The large hole 28 is a pass-through for the dispersal unit 20 at its attachment point to the pressurized vessel cylinder 12. As shown in FIG. 3A, the large hole 28 is oriented in central position about the upper cap 16. It is contemplated, however, that the large hole 28 may be oriented off-center about the upper cap 16, the off-center location corresponding to an alternative attachment point of the dispersal unit 20 to the pressurized vessel cylinder 12. An example of the lower cap 22 is shown in FIGS. 3C and 3D. FIG. 3C shows a cross-sectional illustration of the lower cap 22 having a plurality of small holes 26 disposed therein. FIG. 3D shows a longitudinal-section illustration of the lower cap 22 and a plurality of fasteners 30.

As shown in FIGS. 3A, 3B, 3C, and 3D, the small holes 26 provide pass-throughs for the plurality of fasteners 30. As further shown in FIGS. 3A, 3B, 3C, and 3D, ten small holes are distributed in a symmetrical pattern about the upper cap 16 and lower cap 22. It is contemplated, however, that a different number of holes may be distributed in a different pattern about the upper cap 16 and lower cap 22. The fasteners 30, as shown in FIGS. 3B and 3D, may be of any style, shape, and material suitable for use in a fire extinguisher, as will be recognized by those skilled in the art. Further, the upper cap 16 and lower cap 22 may be welded, or brazed, to the body 14, rather than being assembled using the holes 26 and fasteners 30. Those skilled in the art will recognize the various manners suitable for assembling the pressurized vessel 10 based on the teachings provided herein.

Figure 4A:
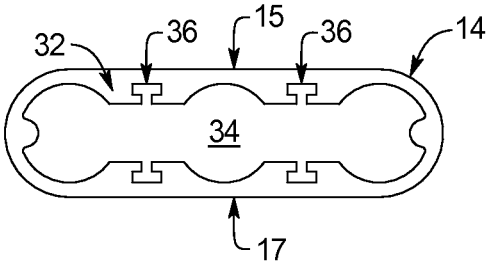
FIG. 4A is a cross-sectional illustration of a cylinder body for a pressurized vessel.
Figure 4B:
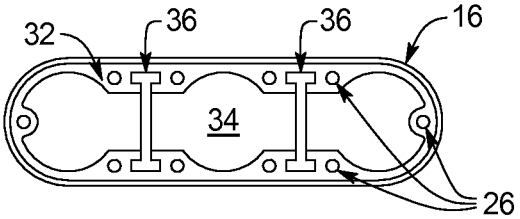
FIG. 4B is a cross-sectional illustration of an upper or lower cylinder body portion for a pressurized vessel.

As shown in the illustrations of FIGS. 4A and 4B, the pressurized vessel cylinder 12 may be oval in cross-section. It is contemplated, however, that the cylinder 12 may have a cross-section that is ovoid, substantially round, rectangular, or any other shape suitable for a pressurized vessel cylinder 12. The illustration of FIG. 4A further shows a cross-section cylinder body 14 wherein cylinder walls 32 define an interior 34. The pressurized vessel cylinder 12 and interior 34 are substantially similar in cross-section, save portions of the walls 32 that intermittently thicken to provide a plurality of channels 36. The illustration of FIG. 4B shows a cross-section of either the upper portion 18 or the lower portion 24 of the pressurized vessel cylinder 12. As shown in FIG. 4B, the thickened portions of the walls 32 have not only a plurality of channels 36, but also a plurality of small holes 26 disposed therein.

FIG. 4B further illustrates a series of internal tension trusses 38 (shown in FIGS. 5A and 5B) harbored within the channels 36. Further, the plurality of small holes 26 disposed within the cylinder walls 32 at the upper portion 18 and the lower portion 24 align with the plurality of small holes 26 disposed within the upper cap 16 and lower cap 22, respectively. The fasteners 30 are provided through the aligned small holes 26 of the upper cap 16 and lower cap 22 and the body 14, thereby securing the upper cap 16 and lower cap 22 to the body 14.

Figure 5A:
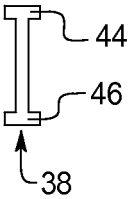
FIG. 5A is a cross-sectional illustration of an internal tension truss for a pressurized vessel.
Figure 5B:
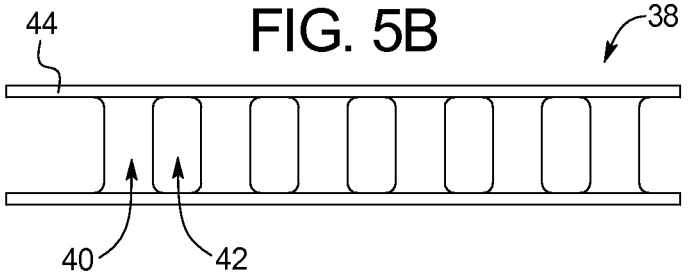
FIG. 5B is a front perspective illustration of the internal tension truss shown in FIG. 5A adapted for use in a pressurized vessel.

FIGS. 5A and 5B illustrate a series of truss structures 38 harbored within the channels 36 (as shown in FIG. 4A). The truss structure 38 connects the first side 15 to the second side 17 of the pressurized vessel cylinder 12, such that under pressurized conditions, the truss structure 38 resists the outward expansion forces to maintain the structural integrity of the pressurized vessel cylinder 12 by substantially maintaining the distance between the first side 15 and the second side 17 of the pressurized vessel cylinder 12 (there may be some minimal outward expansion of the pressurized vessel cylinder 12, as will be recognized by those skilled in the art based on the descriptions provided herein).

In an embodiment, the truss structure 38 may extend from the upper portion 18 to the lower portion 24 of the pressurized vessel cylinder 12. For example, a pair of trusses 38 (as shown in FIG. 4B) may run parallel to one another, both extending the length of the pressurized vessel cylinder 12. It is contemplated, however, that a different number of trusses 38, including a single truss 38, may traverse the interior 34 of the pressurized vessel cylinder 12 at angles, crossways, or laterally. It is further contemplated that the truss structure may span a distance that is less than the full vertical height of the pressurized vessel cylinder 12.

The truss structure 38, as shown in FIG. 5B, is shaped like an I-beam and comprises a first flange 44 and a second flange 46 connected by at least one rung 40. The first flange 44 may be connected to the first side 15 and the second flange 46 may be connected to the second side 17, wherein the first flange 44 and second flange 46 may extend in parallel from the upper portion to the lower portion of the pressurized vessel cylinder 12. As shown in FIG. 5B, which depicts a side view of the truss structure 38, the rungs 40, which maintain the structural integrity of the pressurized vessel cylinder under pressurized conditions, create voids 42 in the truss structure 38. The voids 42 allow the pressurized vessel cylinder 12 to maintain fluid communication throughout the interior 34.

It has been contemplated, however, that the structural pattern of the truss 38 may be different, such a cross hatch pattern. Additionally, the truss structure 38 may be formed of any structural material appropriate for use in a fire extinguisher cylinder. For example, the truss 38 may be formed from aluminum. Of course, numerous known substitutes may be used, as will be recognized by those skilled in the art. It is understood that the truss 38 may be extruded, machined, a combination thereof, or manufacturer in any other suitable manner as will be recognized by those skilled in the art. For example, the truss structure 38 may be extruded together with the body 14 as a single extrusion, whereby the truss voids 42 are then machined following the extrusion process. Further, the body 14 may be extruded as two or more sections and then fastened or welded together.

In a preferred embodiment of the pressurized vessel 10, the pressurized vessel cylinder 12 is oval in cross-section. The physics of oval forms, particularly the pressures, stresses, and forces acting within an oval cylinder, are unique. The oval nature of the pressurized vessel cylinder 12 is supported by the truss structure 38, in conjunction with the upper cap 16 and lower cap 22 fastened to the cylinder body 14. Thus the pressurized vessel cylinder 12 may not only be manufactured to meet the hydrostatic testing and burst strength requirements of ANSI, but also used in methods compliant with the ADADGs.

FIGS. 6, 7, 8, 9, and 10 illustrate methods of using the pressurized vessel 10, 11 in a regulatory compliant manner that may also be aesthetically pleasing or preferred by a pressurized vessel 10 user.

Figure 6:
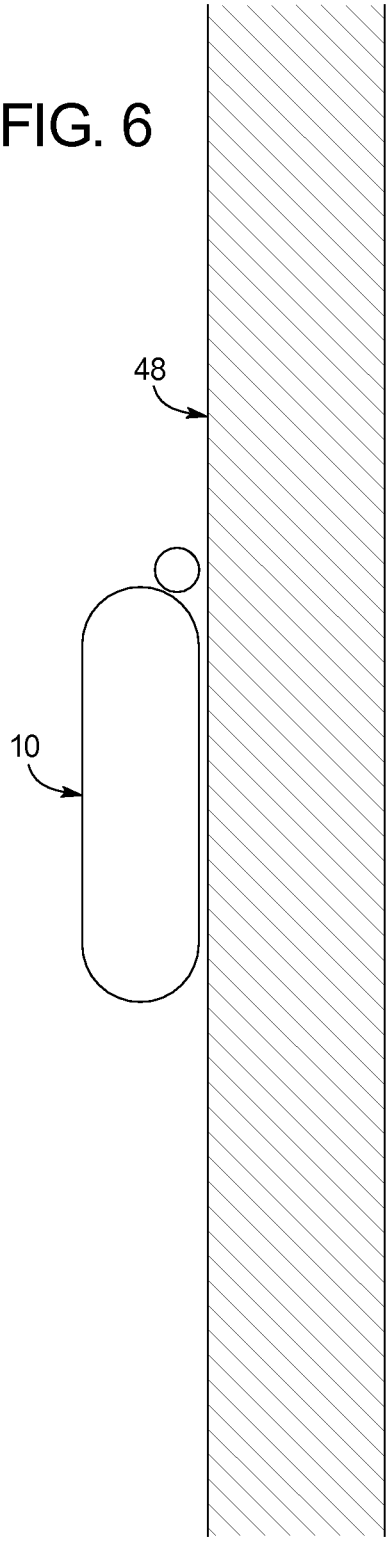
FIG. 6 is cross-sectional illustration of a pressurized vessel directly attached to a mounting surface, such as a wall.

FIG. 6 is cross-sectional illustration of a regulatory compliant pressure vessel 10 directly attached to a mounting surface 48, such as a wall. As shown, the pressure vessel 10 installation may be compliant with the ADADGs because the pressure vessel 10 may not protrude more than 4 inches from the mounting surface 48.

Figure 7:
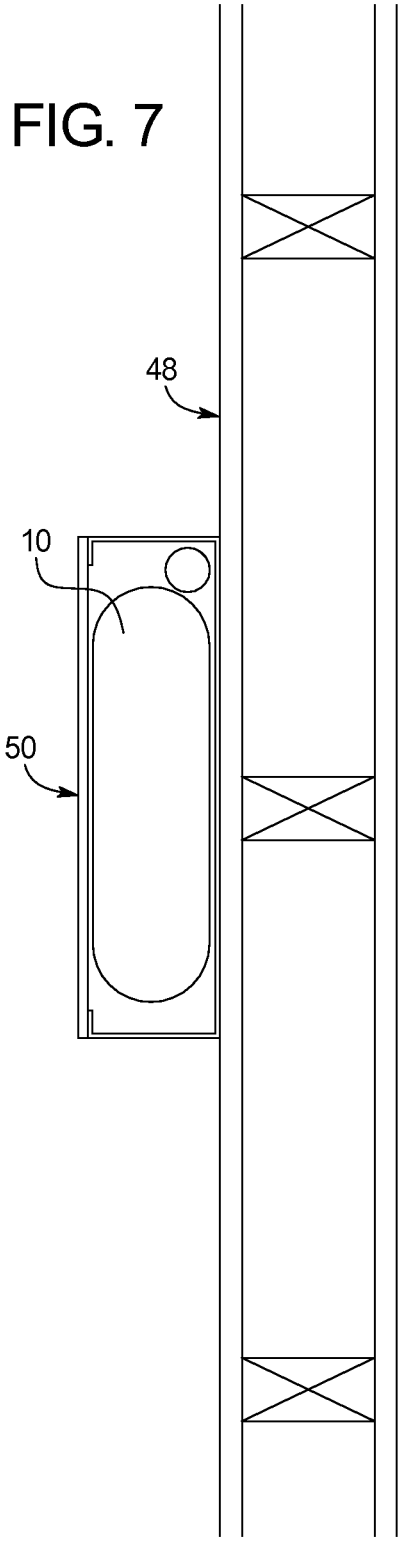
FIG. 7 is a cross-sectional illustration of a pressurized vessel disposed within a cabinet attached to a mounting surface, such as a wall.

FIG. 7 is a cross-sectional illustration of a regulatory compliant pressure vessel 10 disposed within a cabinet 50 attached to a mounting surface 48, such as a wall. As shown, this pressure vessel 10 installation may be compliant with the ADADGs because the pressure vessel 10 and its attendant cabinet 48 do not protrude more than 4 inches from the mounting surface 48.

Figure 8:
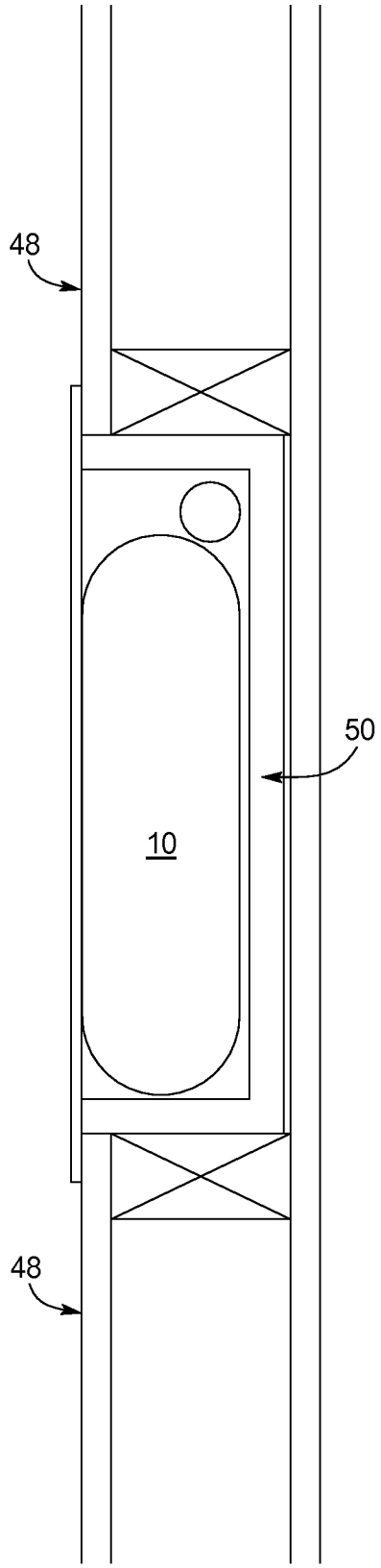
FIG. 8 is a cross-sectional illustration of a pressurized vessel disposed within a cabinet primarily recessed between common depth framing studs of a mounting surface, such as a wall.

FIG. 8 is a cross-sectional illustration of a pressure vessel 10 disposed within a flush or fully recessed cabinet 50 attached to a mounting surface 48, such as a wall. As shown, this pressure vessel 10 installation is compliant with the ADADGs because the pressure vessel 10 and its attendant cabinet 50 do not protrude more than 4 inches from the mounting surface 48. Further, the flush cabinet installation may be aesthetically pleasing a pressure vessel 10 installer.

Figure 9:
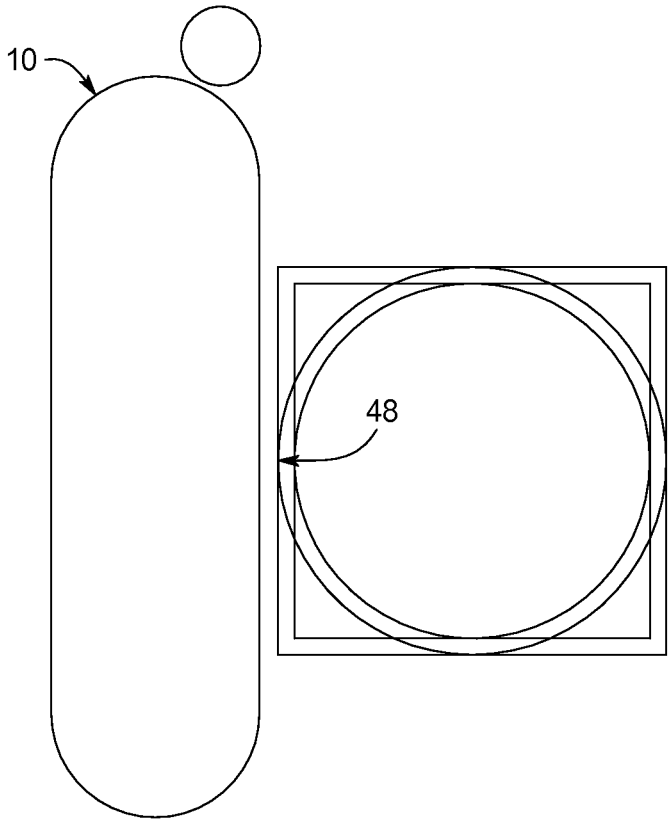
FIG. 9 is a cross-sectional illustration of a pressurized vessel directly attached to a mounting surface, such as a column.

FIG. 9 is cross-sectional illustrations of a pressure vessel 10 directly attached to a mounting surface 48, such as a column. As shown, the pressurized vessel 10 installations are compliant with the ADADGs because the pressurized vessel 10 does not protrude more than 4 inches from the mounting surface 48.

Figure 10:
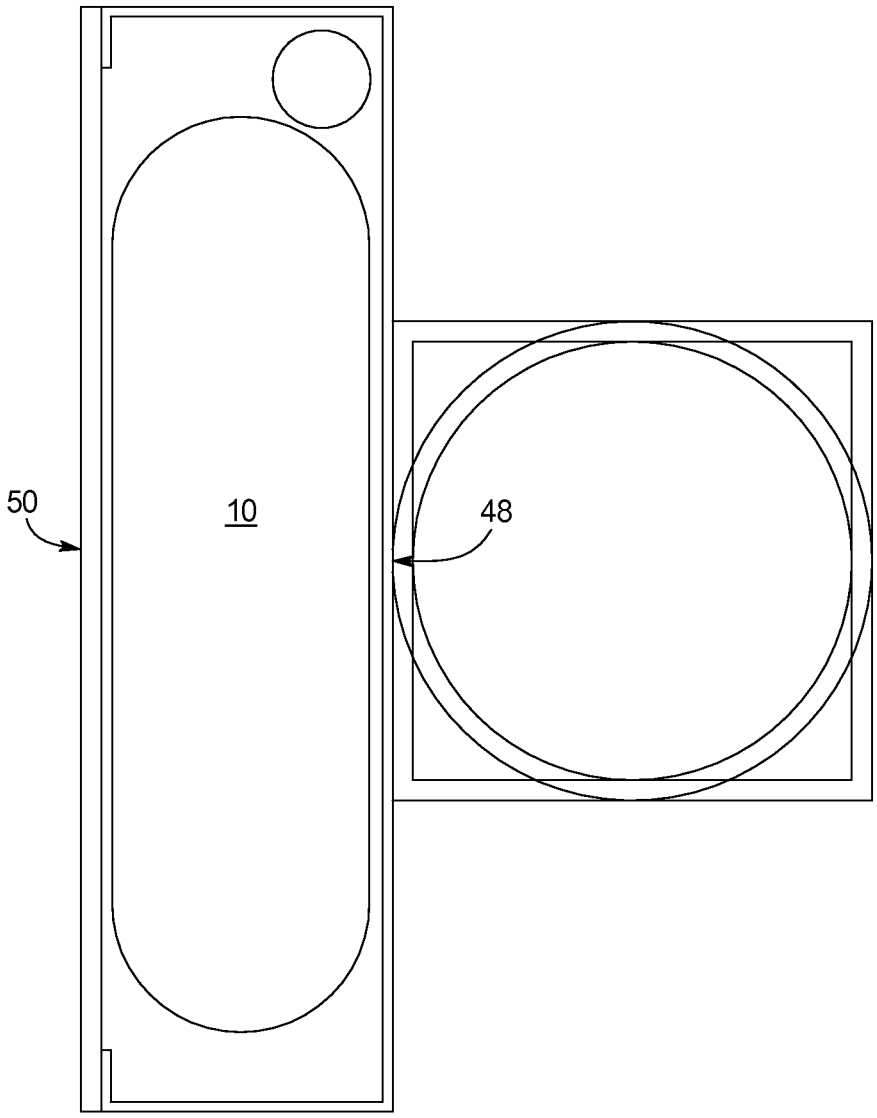
FIG. 10 is a cross-sectional illustration of a pressurized vessel disposed within a cabinet attached to a mounting surface, such as a column.

FIG. 10 is a cross-sectional illustration of a pressurized vessel 10 disposed within a cabinet 50 attached to a mounting surface 48, such as a column. As shown, this pressurized vessel 10 installation is compliant with the ADADGs because the pressurized vessel 10 and its attendant cabinet 450 do not protrude more than 4 inches from the mounting surface 46.

It should be noted that various changes and modifications to the presently preferred embodiments described herein will be apparent to those skilled in the art. Such changes and modifications may be made without departing from the spirit and scope of the present invention and without diminishing its attendant advantages.

I claim:

1. A pressurized vessel cylinder comprising:

a non-circular cylindrical body comprising a first side and a second side, wherein the body defines an interior including a lowest interior surface, the lowest interior surface including a length and a width, wherein the width spans the first side and second side, wherein the length is perpendicular to the width, wherein the interior further includes a height perpendicular to the length and the width of the lowest interior surface, wherein a dispersal unit is located at an upper portion of the height; and at least one truss structure connecting the first side to the second side, wherein said at least one truss structure includes one or more voids, wherein the truss structure does not interfere with fluid communication along the length and the width of the lowest interior surface of the interior of the body across the length and the width of the interior.

2. The pressurized vessel cylinder of claim 1 wherein the truss structure extends from an upper portion of the body to a lower portion of the body.

3. The pressurized vessel cylinder of claim 1 wherein the truss structure is configured to maintain a fixed distance between the first side and second side under pressurized conditions.

4. The pressurized vessel cylinder of claim 1 wherein the truss structure comprises a first flange and second flange connected by at least one rung, wherein the first flange is attached to the first side of the body, wherein the second flange is attached to the second side of the body.

5. The pressurized vessel cylinder of claim 4 wherein the first flange and second flange extend in parallel from the upper portion of the body to the lower portion of the body.

6. The pressurized vessel cylinder of claim 4 wherein the position of the rungs create voids that maintain fluid communication throughout the interior.

7. The pressurized vessel cylinder of claim 1 wherein a cross-section of the body of the cylinder is oval shaped.

8. The pressurized vessel cylinder of claim 1 further comprising an upper cap on the upper portion and a lower cap on the lower portion.

9. The pressurized vessel cylinder of claim 1 wherein the cylinder comprises fire extinguishing agent under pressurized conditions.

10. The pressurized vessel cylinder of claim 1 wherein the truss structure defines a void immediately adjacent the lowest interior surface of the interior of the body so as to not interfere with fluid communication along a lowest interior surface of the interior of the body across the length and the width of the interior.

11. The pressurized vessel cylinder of claim 1 wherein the truss structure extends along the height of the interior to a position above the lowest interior surface of the interior of the body so as to not interfere with fluid communication along a lowest interior surface of the interior of the body across the length and the width of the interior.

12. A pressurized vessel comprising:

a non-circular cylindrical body comprising a first side and a second side, wherein the body defines an interior including a lowest interior surface, and at least one truss structure connecting the first side to the second side, wherein the truss structure does not interfere with fluid communication along the length and width of the lowest interior surface of the interior of the body across the length and the width of the interior;

wherein the lowest interior surface including a length and a width, wherein the width spans the first side and second side, wherein the length is perpendicular to the width, wherein the interior further includes a height perpendicular to the length and the width of the lowest interior surface, wherein a dispersal unit is located at an upper portion of the height, wherein the dispersal unit in communication with the pressurized vessel cylinder enabled to dispense material stored inside the cylinder.

13. The pressurized vessel of claim 12 wherein the truss structure is configured to maintain a fixed distance between the first side and second side under pressurized conditions.

14. The pressurized vessel of claim 12 wherein the pressurized vessel is a fire extinguisher and the material comprises a fire extinguishing agent.

15. The pressurized vessel of claim 12 wherein the pressurized vessel is portable.

16. The pressurized vessel of claim 12 wherein the distance between the first side and the second side is four inches or less.

17. The pressurized vessel of claim 12 further comprising an upper cap on the upper portion of the cylinder and a lower cap on the lower portion of the cylinder.

18. The pressurized vessel of claim 12 where in the pressurized vessel remains structural stable at internal pressures up to 585 psi.

19. The pressurized vessel cylinder of claim 12 wherein the truss structure defines a void immediately adjacent the lowest interior surface of the interior of the body so as to not interfere with fluid communication along a lowest interior surface of the interior of the body across the length and the width of the interior.

20. The pressurized vessel cylinder of claim 12 wherein the truss structure extends along the height of the interior to a position above the lowest interior surface of the interior of the body so as to not interfere with fluid communication along a lowest interior surface of the interior of the body across the length and the width of the interior.

* * * * *